US006878911B2

(12) United States Patent
Behnke et al.

(10) Patent No.: US 6,878,911 B2
(45) Date of Patent: Apr. 12, 2005

(54) DEVICE AND METHOD FOR CLEANING MICROWAVE DEVICES

(75) Inventors: Knut Behnke, Kiel (DE); Hans-Otto Krause, Eckernfoerde (DE); Frank-Michael Morgenweck, Molfsee (DE); Domingo Rohde, Kiel (DE); Detlef Schulze-Hagenest, Molfsee (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/422,317

(22) Filed: Apr. 24, 2003

(65) Prior Publication Data

US 2004/0108312 A1 Jun. 10, 2004

(30) Foreign Application Priority Data

May 28, 2002 (DE) ..... 102 23 665

(51) Int. Cl.[7] ..... H05B 6/80

(52) U.S. Cl. ..... 219/690; 219/674; 399/355

(58) Field of Search ..... 219/690, 674, 219/725, 756, 678, 729, 771, 691, 216; 99/DIG. 14; 399/336, 340, 326, 343, 348, 327, 355; 156/230, 583.1; 134/1, 2, 11, 12

(56) References Cited

U.S. PATENT DOCUMENTS

| | | | | | |
|---|---|---|---|---|---|
| 4,482,239 | A | * | 11/1984 | Hosono et al. | 399/336 |
| 4,511,778 | A | * | 4/1985 | Takahashi et al. | 219/691 |
| 5,290,985 | A | | 3/1994 | Jancic et al. | 219/725 |
| 5,682,578 | A | * | 10/1997 | Shehata et al. | 399/92 |
| 6,453,147 | B1 | * | 9/2002 | Morse et al. | 399/353 |
| 6,656,288 | B2 | * | 12/2003 | Cherry | 134/1 |

FOREIGN PATENT DOCUMENTS

| | | | | |
|---|---|---|---|---|
| DE | 3937720 A | * | 5/1991 | B08B/7/00 |
| DE | 198 29 676 A1 | | 2/1999 | B05D/7/26 |

* cited by examiner

*Primary Examiner*—Quang T. Van
(74) *Attorney, Agent, or Firm*—Lawrence P. Kessler

(57) ABSTRACT

Cleaning a microwave device, in particular for drying print substrate in a printing machine, with a microwave source providing an irradiation field and a resonator chamber, wherein a microwave-penetrable material on the inside surfaces of the resonator chamber for forming a material layer that allows any dirt accumulated on it to protrude into the irradiation field.

3 Claims, 1 Drawing Sheet

DEVICE AND METHOD FOR CLEANING MICROWAVE DEVICES

FIELD OF THE INVENTION

The invention relates to microwave fusing wherein a material on the inside surfaces of the microwave resonator allows dirt to be accumulated and to protrude into the irradiation field of the resonator.

Microwave devices are used in many areas of technology. One application of microwaves is the heating of objects, such as microwave ovens in households. One particular application of microwave devices is as a fusing device in printing machines, whereby the image applied to a print substrate, by toner for example, is fused to the print substrate as the toner melts due to the heating of the toner and of the image carrier material by microwave energy, and the toner is interlocked with the print substrate. The problem is that, over time, dirt appears in the microwave device of the printing machine, which leads to loss of the unused microwave energy and reduces the efficiency of the microwave device. Furthermore, the dirt can lead to arcing and cause malfunctions in the microwave device.

SUMMARY OF THE INVENTION

The object of the invention is thus to provide a microwave device and a method for cleaning a microwave device, whereby the microwave device is easy to clean and thus has a reliable operating state with a high degree of efficiency.

This object is obtained by this invention wherein a microwave device is provided, in particular for the fusing of toner on a print substrate in a printing machine, with a microwave source providing an irradiation field and a resonator chamber. A microwave-penetrable material is included on the inside surfaces of the resonator chamber for the formation of a material layer that allows any dirt accumulating on it to protrude into the irradiation field. The cleaning of a microwave device is considerably simplified with the above-mentioned characteristics, as a result of which a consistent high degree of efficiency of the microwave device is obtained and the reliability of the microwave device is increased due to less downtime. The costs of expensive chemicals to clean the state-of-the-art microwave device, which are a health hazard and which give cause for concern about the environment, are saved.

In one of the embodiments of the invention, the material repels dirt and a device for supplying a first medium, which does not absorb the microwave irradiation, is provided for cleaning the resonator chamber of dirt essentially from the inside surfaces of the resonator chamber, whereby the dirt is heated by microwave irradiation and carried out of the resonator chamber by the first medium. The dirt-repelling material may comprise the economical material polytetrafluorethylene or polyvinylildene fluoride. A material thickness of 0.5 mm on the inside surfaces of the resonator chamber has proved to be advantageous with respect to material costs and efficiency.

In a first operating state, a stationary microwave is formed in the resonator chamber, whereby, in the first operating state, a print substrate can be conducted through a passage in the resonator chamber, and, in a second operating state, an active microwave is formed in the resonator chamber, whereby, in the second operating state, the first medium to clean the resonator chamber of dirt can essentially be supplied from the inside surfaces of the resonator chamber.

In a special further development, a chamber is provided, which is empty in the first operating state, and in which, in the second operating state, a second medium can be supplied, whereby the second medium largely absorbs the microwave irradiation and ensures that an active irradiation field is formed in the resonator chamber by the microwave source while ensuring the heating and vaporization of the dirt of essentially all the inside surfaces of the resonator chamber. The inside surfaces of the resonator chamber are uniformly filled with microwave energy by the active irradiation field at a point at which high microwave energy is located at a certain point in time, and, in the next moment, a lower microwave energy is found. The distribution of microwave energy is then approximately the same for all points on the inside surfaces of the resonator chamber. The inside surfaces of the resonator chamber are uniformly cleaned in this manner.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
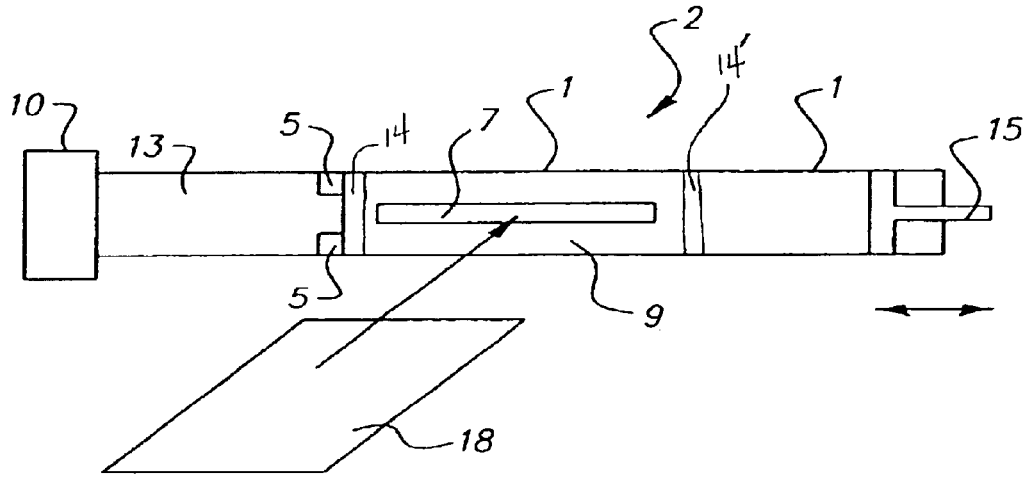
FIG. 1 shows a schematic lateral section of a microwave device as one embodiment of the invention.

Referring now to the accompanying drawings, FIG. 1 shows a schematic lateral section of a microwave device 2 as an embodiment of the invention for fusing toner to a print substrate 18. A magnetron 10 is located on the left side of the microwave device 2 to generate microwaves. Attached to the magnetron 10 is an activating converter 13 to inject the microwaves into a resonator chamber 9. An orifice is located between the activating converter and the resonator chamber.

The resonator chamber 9 has a passage 7 in the lateral surface to conduct the print substrate 18 through the resonator chamber 9. The print substrate 18 is conducted through the resonator chamber 9 in the direction of the illustrated arrow. A corresponding passage is located in the opposite lateral surface of the resonator chamber 9 to guide the print substrate 18 out of the resonator chamber 9. On the right side of the resonator chamber 9 of the microwave device 2, there is a metal closing slide valve 15 that can be moved in the horizontal direction to the resonator chamber 9 and which extends into the resonator chamber 9. The closing slide valve 15 consists of a rod and a rectangular surface at the end of the rod that is vertically connected with the rod and seals off the resonator chamber 9 in such a way that a good electrical contact of the closing slide valve 15 to the inside surfaces of the resonator chamber 9 exists.

The inside surfaces of the resonator chamber 9 have a microwave-penetrable material, preferably polytetrafluorethylene (PFTE) or polyvinylildene fluoride (PVDF). The microwave-penetrable material 1 may consist of a coating of the inside surfaces of the resonator chamber 9, of dispersion layers or multiple layers. Ideally, the thickness of the microwave-penetrable material 1 is selected below approximately 500 μm. If the microwave-penetrable material 1 has a thickness that is greater than approximately 500 μm, the microwave-penetrable material 1 may contain solid materials, such as films or sheets, which are attached to the inside surfaces of the resonator chamber 9. With increasing thickness of the microwave-penetrable material 1, the tendency to arc in the resonator chamber 9 is reduced, since the dielectric strength of polytetrafluorethylene, for example, is considerably higher than that of air. As a result, the operating safety and reliability of the microwave device 2 increases.

There is a polytetrafluorethylene wafer 14, 14' on either end of the resonator chamber 9. The polytetrafluorethylene wafer 14 on the left end of the resonator chamber 9 is arranged between the orifice 5 and the resonator chamber 9. The polytetrafluorethylene wafer 14 forms a seal on the left side of the resonator chamber 9, according to FIG. 1, while the polytetrafluorethylene wafer 14' forms a separation of the resonator chamber 9 and divides it into two parts. The polytetrafluorethylene wafers 14, 14' can essentially be penetrated by microwaves.

Furthermore, the polytetrafluorethylene wafers 14, 14' repel dirt. Due to the microwave-penetrable material 1, the inside surfaces of the resonator chamber 9, in comparison with the state-of-the art resonator chambers, are only slightly dirty. Dirtying the inside surfaces of the resonator chamber 9 absorbs microwave energy, leads to arcing and malfunctions and thus is undesirable. The microwave-penetrable, dirt-repelling material 1 protrudes into the irradiation field in the resonator chamber 9. As a result, the loosening of dirt particles from the inside surfaces of the resonator chamber 9 by the microwaves is considerably simplified. Dirt on the inside surfaces of the resonator chamber 9, is easily loosened and essentially forms no stubborn layers of dirt, which can only be removed with difficulty. The resonator chamber 9 is thus easier for an operator to clean than the state of the art disclosed to date. The irradiation field in the resonator chamber 9 is not affected or only slightly by the microwave-penetrable material 1.

Figure 2:
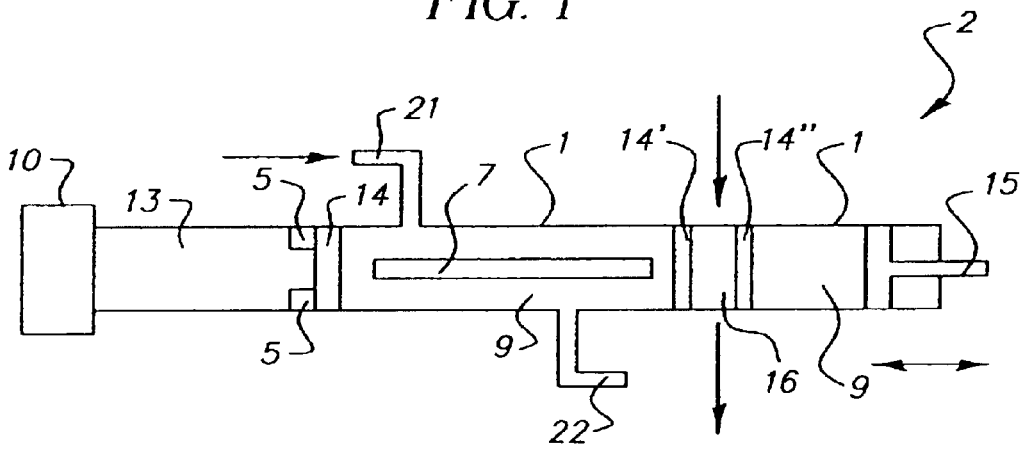
FIG. 2 shows a schematic lateral section as another embodiment of the invention with an inlet and an outlet in the resonator chamber for the supplying or discharging of a first medium and a chamber, through which the medium flows.

FIG. 2 shows a schematic lateral section of a microwave device 2 as another embodiment of the invention to fuse toner on a print substrate 18. A magneton 10 is located on the left side of the microwave device 2 to generate microwaves. An activating convener 13 is attached to the magnetron 10 to inject microwaves into a resonator chamber 9. An orifice 5 is located between the activating converter 13 and the resonator chamber 9. The resonator chamber 9 has a passage 7 in the lateral surface to conduct the print substrate 18 through the resonator chamber 9. The print substrate 18 is guided through the resonator chamber 9 according to FIG. 1. A corresponding passage is located on the opposite lateral surface of the resonator chamber 9. On the right side of the resonator chamber 9 is located a metal closing slide valve 15, which can be moved in the horizontal direction to the resonator chamber 9 and which protrudes into the resonator chamber 9. The closing slide valve 15 consists of a rod and a rectangular surface at the end of the rod, which is vertically connected to the rod and the resonator chamber 9 is sealed in such a way that a good electrical contact of the closing slide valve 15 to the inside surfaces of the resonator chamber 9 exists.

The inside surfaces of the resonator chamber 9 are covered with a dirt-repelling material 1, preferably polytetrafluorethylene (PTFE) or polyvinylildene fluoride (PVDF). The dirt-repelling material 1 may consist of a coating of the inside surfaces of the resonator chamber 9. There is a polytetrafluorethylene wafer 14, 14' on either end of the resonator chamber 9. The polytetrafluorethylene wafer 14 is arranged on the left end of the resonator chamber 9 between the orifice 5 and the resonator chamber 9, while the other polytetrafluorethylene wafer 14' is located on the right end of resonator chamber 9 between the resonator chamber 9 and a chamber 16. The resonator chamber 9 has an inlet 21 and an outlet 22. Through the inlet 21, the resonator chamber 9 is supplied with a first medium with a certain pressure, which is dispersed in the resonator chamber 9, which leaves the resonator chamber 9 with a certain suction through the outlet 22, and the resonator chamber 9 is thus flushed with the first medium. The first medium is preferably air, which carries dirt found in the resonator chamber 9 out through the outlet 22.

The flushing with the first medium is preferably carried out in the second operating state, in which the resonator chamber 9 is cleaned. The chamber 16 is sealed off on one side by the wafer 14' on the right side of the resonator chamber 9, and, on the other side of the chamber 16, by another polytetrafluorethylene wafer 14", and the chamber 16 has one orifice on its upper side and one on its lower side, through which a second medium flows in or flows out. In the event that the second medium does not flow through the chamber 16, a stationary microwave is formed in the resonator chamber 9, the microwave passes through the resonator chamber 9, the wafers 14, 14', 14" and the chamber 16, and is reflected on the rectangular surface of the closing slide valve 15. This event is designated as the first operating state in the above description, in which the print substrate 18 is conducted through the resonator chamber 9 and the toner is fused to the print substrate 18. The first operating state is the usual operating state of the microwave device 2 for fusing toner on the print substrate 18 in the printing machine.

By comparison, when the resonator chamber 9 is cleaned, the second medium flows through the chamber 16 and fills the chamber 16 completely. The second medium with this embodiment is, for example, water. The second medium essentially absorbs the microwaves in the resonator chamber 9, and thus the microwaves are not reflected on the surface of the closing slide valve 15, and do not form any stationary microwave, in contrast to the first operating state in which a stationary microwave is formed in the resonator chamber 9. The second medium is heated by the microwave radiation. An active irradiation field is formed in the resonator chamber 9 in the second operating state with the flow of the second medium through the chamber 16. The inside surfaces of the resonator chamber 9 are uniformly filled with microwave energy, at a point at which high microwave energy is located, while, in the next moment, a lower microwave energy is found. This active irradiation in the second operating state contrasts with the stationary, resonant irradiation field in the first operating state, in which the toner is fused to the print substrate, the so-called fusing. The inside surfaces of the resonator chamber 9 are uniformly cleaned in this manner. In comparison to the solution according FIG. 1, the cleaning of the resonator chamber 9 is carried out without manual cleaning by the operator and another improvement of the cleaning of the inside surfaces of the resonator chamber 9 is achieved. The second operating state is carried out until a suitable cleaning of the resonator chamber 9 is achieved.

Figure 3:
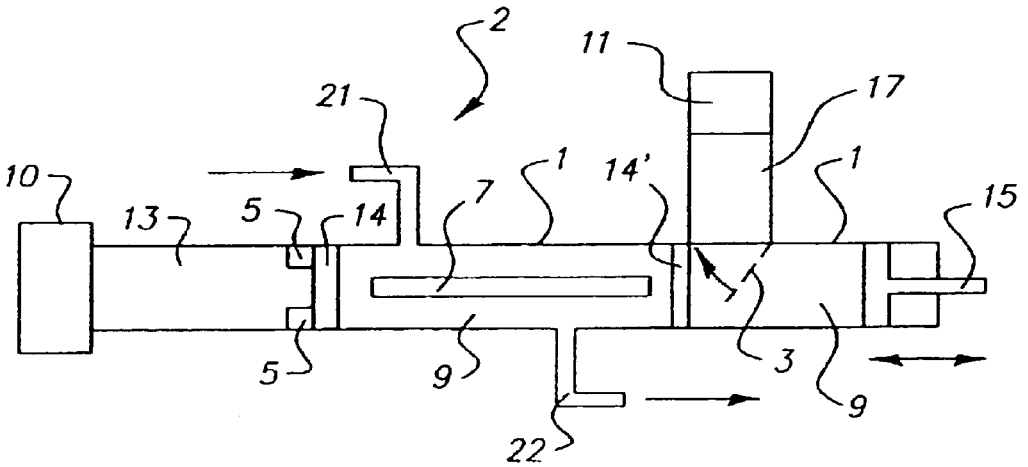
FIG. 3 shows a schematic lateral section of a microwave device of another embodiment of the invention with a valve that protrudes into the resonator chamber in the second operating state.

FIG. 3 shows a schematic lateral section of a microwave device 2 of another embodiment similar to FIG. 2. Similar to the embodiment according to FIG. 2, through the inlet 21 with a certain pressure, the resonator chamber 9 is supplied with a first medium, which is dispersed in the resonator chamber 9 and which leaves the resonator chamber 9 with a certain suction through the outlet 22, and the resonator chamber 9 is thus flushed with the first medium. The first medium is preferably air, which carries dirt that is found in the resonator chamber 9 out through the outlet 22. The flushing is preferably carried out with the first medium in the second operating state, in which the resonator chamber 9 is cleaned. The microwave device 2 comprises a container 17 that is arranged above the microwave device 2 and a water load 11. The container 17 is open on its lower side, which is facing the microwave device 2, and is closed on the other side. The microwave device 2 has an opening at the point at which the open side of the container 17 touches the microwave device 2. There is thus a spatial relationship between the container 17 and the resonator chamber 9.

On the lower end of the container 17, there is a valve 3, which is firmly attached to the microwave device 2 so that it can swivel and which can be swiveled in the microwave device 2. The valve 3 consists of an electrically conductive material. In the closed position, the first operating state, the valve 3 covers the opening of the container 17 completely, so that the inside of the container 17 is separated from the inside of the microwave device 2. In the closed position, the valve 3 does not protrude into the microwave device 2. In this first operating state with a closed valve 3, a stationary microwave is formed in the resonator chamber 9, which is reflected on the valve 3, which serves to fuse toner to the print substrate 18. In order to begin the second operating state for cleaning the resonator chamber 9, the valve 3 is opened and the valve 3 protrudes into the resonator chamber 9, so that a spatial relationship is produced between the container 17 and the microwave device 2. When the valve 3 protrudes into the microwave device 2 in the second operating state, it has a 45° angle in relationship to the propagation direction. In the second operating state, the irradiation field also propagates into the container 17 with the water load; the stationary microwave in the first operating state becomes an active microwave in the second operating state. The microwave is deflected on the electrically conductive valve 3. As described above, a uniform cleaning of the inside surfaces of the resonator chamber is ensured by the active microwave in the resonator chamber 9. The resonant, stationary microwave of the first operating state is converted into an active microwave by the absorption of the microwave in the water load 11. The water load serves as an absorber for the microwave and is flushed with water. It is important that the water load is arranged on the opposite side of the microwave source. The flushing of the water load is necessary in order to replace the water heated by the converted microwave energy. In FIG. 3, the second polytetrafluorethylene wafer 14' serves basically to prevent the condensation of the dirt in the area behind the valve 3.

The invention has been described in detail with particular reference to certain preferred embodiments thereof, but it will be understood that variations and modifications can be effected within the spirit and scope of the invention.

What is claimed is:

1. Method for cleaning a microwave device (2) comprising the steps of: establishing a first operating state wherein, a stationary microwave is formed in the resonator chamber (9), and a print substrate is conducted through a passage (7) in the resonator chamber (9); and establishing a second operating state wherein an active microwave is formed in the resonator chamber (9), and a first medium is supplied for cleaning the resonator chamber (9) of dirt essentially from the inside surfaces of the resonator chamber (9).

2. Method according to claim 1, wherein a chamber (16) is empty in the first operating state, and in the second operating state, a second medium is supplied, whereby the second medium largely absorbs the microwave radiation and ensures that an active irradiation field is formed by the microwave source (10) while ensuring the heating and vaporization of the dirt on essentially all the inside surfaces of the resonator chamber (9).

3. Method according to claim 2, wherein a water load (11) in a containter (17), connected to the resonator chamber (9), is covered during the first operating state by an electrically conductive valve (3) and a stationary microwave is formed in the resonator chamber (9), and during the second operating state the valve (3) is tilted by approximately 45° in relationship to the propagation direction and protrudes into the microwave device (2), and an active microwave is formed in the resonator chamber (9).

* * * * *